US010624396B2

(12) United States Patent
Cheung

(10) Patent No.: US 10,624,396 B2
(45) Date of Patent: Apr. 21, 2020

(54) VELVET SHEATH FOR BRA WIRE RINGS AND BRA USING THE SAME

(71) Applicant: Kaiping Kelian Knitters Development Co., Ltd., Guangdong (CN)

(72) Inventor: Suilung Cheung, Guangdong (CN)

(73) Assignee: KAIPING KELIAN KNITTERS DEVELOPMENT CO., LTD., Guangdong (CN)

( * ) Notice: Subject to any disclaimer, the term of this patent is extended or adjusted under 35 U.S.C. 154(b) by 15 days.

(21) Appl. No.: 16/014,655

(22) Filed: Jun. 21, 2018

(65) Prior Publication Data

US 2018/0360135 A1 Dec. 20, 2018

Related U.S. Application Data

(63) Continuation of application No. PCT/CN2016/108885, filed on Dec. 7, 2016.

(30) Foreign Application Priority Data

Dec. 25, 2015 (CN) ..... 2015 1 1010022

(51) Int. Cl.
*A41C 3/12* (2006.01)
*D03D 3/02* (2006.01)
(Continued)

(52) U.S. Cl.
CPC ..... *A41C 3/12* (2013.01); *A41C 3/0007* (2013.01); *A41C 3/122* (2013.01); *D03D 1/00* (2013.01);
(Continued)

(58) Field of Classification Search
CPC ..... A41C 3/12; A41C 3/122; A41C 3/0021; A41C 3/0007
(Continued)

(56) References Cited

U.S. PATENT DOCUMENTS 6,106,363 A * 8/2000 Werner ..... A41C 3/122 450/41
6,206,753 B1 * 3/2001 Werner ..... A41C 3/122 450/41
(Continued)

FOREIGN PATENT DOCUMENTS

CN 1395891 2/2003
CN 101270525 9/2008
(Continued)

*Primary Examiner* — Gloria M Hale
(74) *Attorney, Agent, or Firm* — Muncy, Geissler, Olds & Lowe, P.C.

(57) ABSTRACT

A velvet sheath for bra wire rings and a bra using the velvet sheath, the sheath comprises a main body holding a hollow part and formed by an upper fabric and a lower fabric, both sides of the hollow part of main body interweave and connect the upper fabric and the lower fabric to form velvet woven grid surfaces by velvet warp threads crossed up and down, respectively, and the sheath is sewn under the bra cup. The velvet sheath for bra wire rings according to the present invention will not appear rough surface and uneven elasticity caused by wire rings pulling the sheath after wire rings inserted into the curvedly sewn sheath or when users wear such bras later, and may ameliorate deformation, wrinkles and tightness of the sheath caused by the uneven tension formed by bending of wire rings and can cushion the compression induced by bending of wire rings without affecting the effect of the sheath on fixing the wire rings.

8 Claims, 2 Drawing Sheets

(51) Int. Cl.

| | |
|---|---|
| ***D03D 1/00*** | (2006.01) |
| ***D03D 11/02*** | (2006.01) |
| ***A41C 3/00*** | (2006.01) |

(52) U.S. Cl.
CPC ..... *D03D 3/02* (2013.01); *D03D 11/02* (2013.01); *D10B 2403/021* (2013.01); *D10B 2501/02* (2013.01)

(58) Field of Classification Search
USPC ..... 450/41, 43, 49, 51, 52
See application file for complete search history.

(56) References Cited

U.S. PATENT DOCUMENTS

| | | | | |
|---|---|---|---|---|
| 7,429,205 | B1 * | 9/2008 | Huang | A41C 3/142 2/267 |
| 8,672,727 | B2 * | 3/2014 | LaRoux | A41C 3/0028 450/41 |

FOREIGN PATENT DOCUMENTS

| | | | |
|---|---|---|---|
| CN | 201563628 | | 9/2010 |
| CN | 203913411 | | 11/2014 |
| CN | 105455209 | A | 4/2016 |
| CN | 205214233 | U | 5/2016 |
| JP | 11100704 | | 4/1999 |

* cited by examiner

VELVET SHEATH FOR BRA WIRE RINGS AND BRA USING THE SAME

TECHNICAL FIELD

The invention relates to the technical field of bra, in particular to a velvet sheath for bra wire rings and a bra using the velvet sheath.

BACKGROUND

A bra plays an indispensable role to females' appearance shaping and health, and the ring under the bra cup has an effect of supporting and protecting the breasts. Since the wire ring can't be sewn together with other parts of the bra because of its material, a sheath for bra wire rings has been designed in the industry, so that the wire ring is combined with other parts of the bra through sewing the sheath with the other parts of the bra into an integration and inserting the wire ring into the sheath. As a result, the manufacturing process and time for placing wire rings in the bra are reduced, and the discomfort to the skin caused by the stiff material of the wire rings is buffered, which eliminates the tension to the skin caused by the wire rings to a certain extent.

At present, for the commonly used sheathes, after the wire rings inserted, the uneven tension formed by wire ring bending will lead to deformation, wrinkles and tightness without fluffiness of the sheath. Besides, both ends of the hollow part of the sheath are not smooth and hard to the touch, affecting the comfort of wearing the bra for females. Thus, it is quite necessary to improve the sheath for bra wire rings.

SUMMARY OF THE INVENTION

In view of the above disadvantages on the existing sheathes for bra wire rings, the present invention provides a velvet sheath for bra wire rings, which has characteristics of improving deformation, wrinkles and tightness of the sheath caused by the uneven tension formed by bending of wire rings and making the both ends of the hollow part of the sheath smooth to ameliorate the feeling, resulting in more comfort of wearing for females.

In order to achieve the above objective, the present invention provides a velvet sheath for bra wire rings, comprising a main body holding a hollow part and formed by an upper fabric and lower fabric, wherein both sides of the hollow part of the main body are provided with velvet warp threads for connecting with the upper fabric and the lower fabric, the upper fabric and the lower fabric are interwoven and connected by the velvet warp threads crossed up and down, and the velvet warp threads are filled on both sides of the hollow part formed by the upper fabric and the lower fabric. The velvet sheath for bra wire rings according to the present invention will not appear rough surface and uneven elasticity caused by wire rings pulling the sheath after wire rings inserted into the curvedly sewn sheath or when users wear such bras later, as velvet warp threads are filled on both sides of the hollow part. It may also ameliorate deformation, wrinkles and tightness of the sheath caused by the uneven tension formed by bending of wire rings and can cushion the compression induced by bending of wire rings without affecting the effect of the sheath on fixing the wire rings. Furthermore, the velvet woven grid surface enables the bra to maintain fluffiness in the position of the sheath and both ends of the hollow part smooth, thus greatly improving comfort in wearing.

Further, the velvet warp threads form velvet woven grid surfaces on both sides of the hollow part of the sheath. The height of the velvet woven grid surfaces is equal to the height of the hollow part. The upper fabric and the lower fabric are not tightly seamed by the velvet warp threads on both sides of the hollow part, but only connected by the velvet warp threads to form the velvet woven grid surfaces on both sides of the original hollow part, so that the height of the velvet woven grid surfaces is equal to the height of the hollow part. The velvet woven grid surfaces in such height filled on both sides of the hollow part form support to ensure that the hollow part will not be flattened easily in process of sewing, which is helpful for wire rings to be inserted.

Further, the ratio of the width between the velvet woven grid surfaces on both sides of the hollow part to the width of the hollow part is between ½ and ⅘. The width of the hollow part is between 8 and 13 mm, and the width of the velvet woven grid surfaces on both sides of the hollow part is between 6 and 10 mm.

Preferably, the width of the hollow part is between 10 and 12 mm, and the width between the velvet woven grid surfaces on both sides of the hollow part is between 7 and 9 mm. Accordingly, the remaining width of the hollow part after velvet weaving is enough for the wire ring to be inserted, and the width of the velvet is configured to cushion deformation and compression caused by wire ring bending without affecting the effect of the sheath on fixing the wire ring.

Preferably, the main body is integrally formed by weaving.

Based on the above velvet sheath for bra wire rings, the patent invention also provides a bra with the above velvet sheath sewn under the bra cups.

The present invention has desirable advantages that the upper fabric and the lower fabric are interwoven and connected by the velvet warp threads crossed up and down, the velvet warp threads are filled on both sides of the hollow part formed by the upper fabric and the lower fabric and form velvet woven grid surfaces on both sides of the hollow part, in same height with the hollow part, so that it will not appear rough surface and uneven elasticity caused by wire rings pulling the sheath after wire rings inserted into the curvedly sewn sheath or when users wear such bras later. It may also ameliorate deformation, wrinkles and tightness of the sheath caused by the uneven tension formed by bending of wire rings and can cushion the compression induced by bending of wire rings without affecting the effect of the sheath on fixing the wire rings. Furthermore, the velvet woven grid surface enables the bra to maintain fluffiness in the position of the sheath and smooth on both ends of the hollow part, thus greatly improving comfort in wearing.

DETAILED DESCRIPTION

The specific structure of the invention will be explained in details combining with the drawings below.

Figure 1:
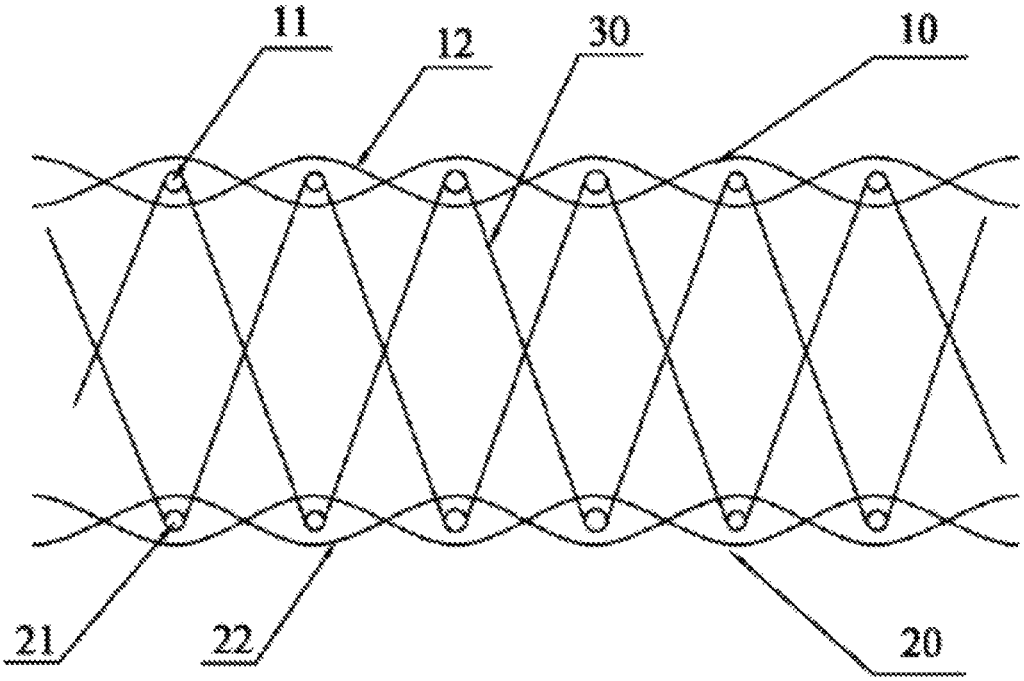
FIG. 1 shows a structural diagram of the velvet woven grid surfaces on both sides of the hollow part of the velvet sheath for bra wire rings according to the present invention.

As shown in FIG. 1, the invention provides a velvet sheath for bra wire rings, comprising a main body holding a hollow part and formed by an upper fabric 10 and lower fabric 20, wherein both sides of the hollow part of the main body are provided with velvet warp threads connected with the upper fabric and the lower fabric, the upper fabric 10 and the lower fabric 20 are interwoven and connected by the velvet warp threads crossed up and down, and the velvet warp threads 30 are filled on both sides of the hollow part formed by the upper fabric 10 and the lower fabric 20 to form velvet woven grid surfaces on both sides of the hollow part. Particularly, the upper fabric 10 is interwoven by upper weft threads 11 and upper warp threads 12, and the lower fabric 20 is interwoven by lower weft threads 21 and lower warp threads 22. The velvet sheath for bra wire rings according to the present invention will not appear rough surface and uneven elasticity caused by wire rings pulling the sheath after wire rings inserted into the curvedly sewn sheath or when users wear such bras later, as velvet warp threads are filled on both sides of the hollow part. It may also ameliorate deformation, wrinkles and tightness of the sheath caused by the uneven tension formed by bending of wire rings and can cushion the compression induced by bending of wire rings without affecting the effect of the sheath on fixing the wire rings. Furthermore, the velvet woven grid surface enables the bra to maintain fluffiness in the position of the sheath and smooth on both ends of the hollow part, thus greatly improving comfort in wearing.

Figure 2:
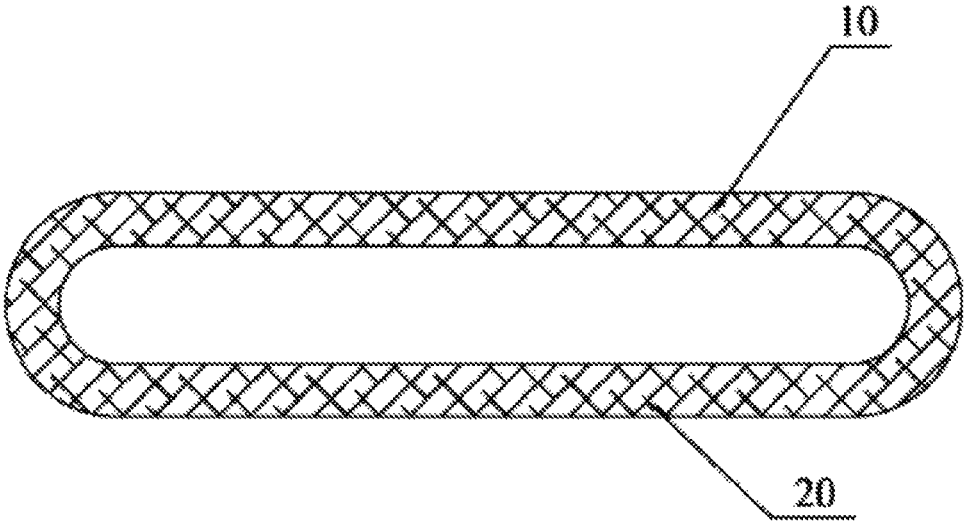
FIG. 2 shows a longitudinal section view of a common sheath for bra wire rings.

FIG. 2 shows a longitudinal section view of a common sheath for bra wire rings. The common sheath does not have velvet grid surfaces woven by velvet weaving, so that after the wire ring is inserted, the uneven tension formed by wire ring bending will lead to deformation, wrinkles and tightness without fluffiness of the sheath. The sheath may even appear rough surface and uneven elasticity caused by wire rings pulling the sheath, besides, both ends of the hollow part of the sheath are not smooth and hard to the touch, affecting the comfort of wearing for females.

Figure 3:
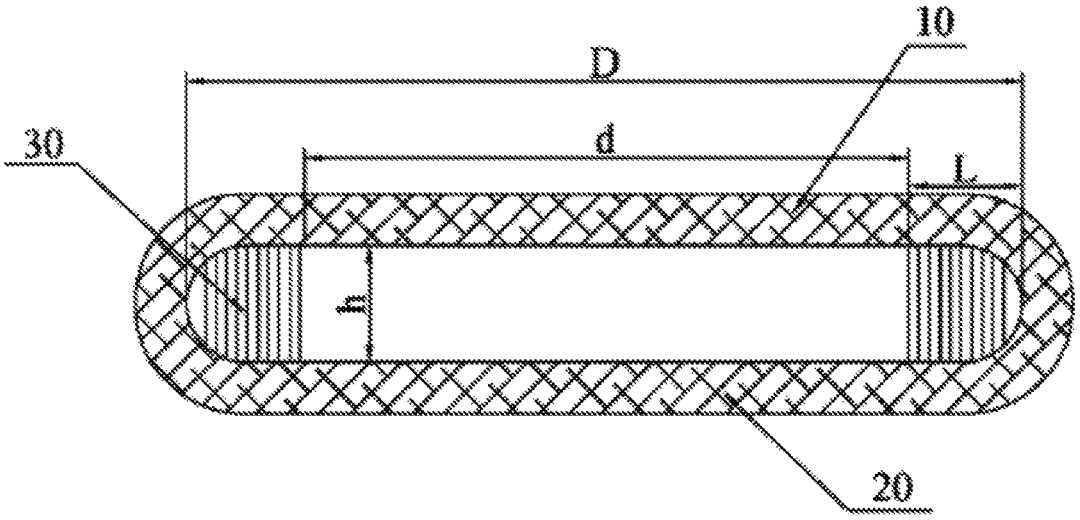
FIG. 3 shows a longitudinal section view of a velvet sheath for bra wire rings according to the present invention.
Figure 4:
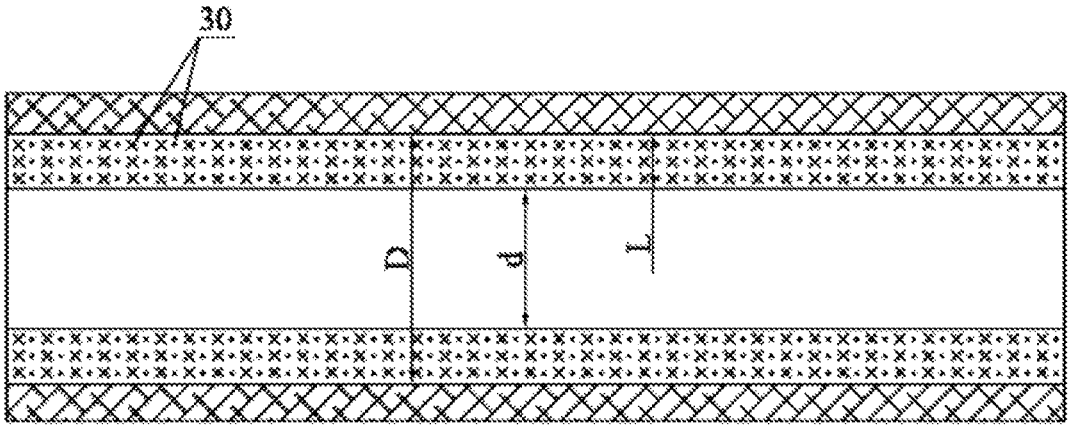
FIG. 4 shows a cross section view of a velvet sheath for bra wire rings according to the present invention.

As shown in FIG. 3 and FIG. 4, the velvet warp threads form velvet woven grid surfaces on both sides of the hollow part of the sheath. The height h of the velvet woven grid surfaces is equal to the height of the hollow part. The upper fabric 10 and the lower fabric 20 are not tightly seamed by the velvet warp threads on sides of the hollow part, but only connected by the velvet warp threads 30 to form the velvet woven grid surfaces on both sides of the original hollow part, so that the height of the velvet woven grid surfaces is equal to the height of the hollow part. The velvet woven grid surfaces in such height form supports in the hollow part to ensure that the hollow part will not be flattened easily in process of sewing, which is helpful for wire rings to be inserted.

The ratio of the width d between the velvet woven grid surfaces on sides of the hollow part to the width D of the hollow part is in the range of between ½ and ⅘. The width D of the hollow part is between 8 and 13 mm, and the width d of the velvet woven grid surfaces on sides of the hollow part is between 6 and 10 mm.

Preferably, the width D of the hollow part is between 10 and 12 mm, and the width d between the velvet woven grid surfaces on sides of the hollow part is between 7 and 9 mm. Accordingly, the remaining width of the hollow part after velvet weaving is enough for the wire ring to be inserted, and the width L of the velvet is configured to cushion deformation and compression caused by wire ring bending without affecting the effect of the sheath on fixing the wire ring.

Preferably, the main body is integrally formed by weaving.

Based on the above velvet sheath for bra wire rings, the present invention also provides a bra with the above velvet sheath sewn under bra cups.

According to the present invention, the upper fabric and the lower fabric are interwoven and connected by the velvet warp threads crossed up and down, the velvet warp threads are filled on both sides of the hollow part formed by the upper fabric and the lower fabric and form velvet woven grid surfaces on both sides of the hollow part, in same height with the hollow part, so that it will not appear rough surface and uneven elasticity caused by wire rings pulling the sheath after wire rings inserted into the curvedly sewn sheath or when users wear such bras later. It may also ameliorate deformation, wrinkles and tightness of the sheath caused by the uneven tension formed by bending of wire rings and can cushion the compression induced by bending of wire rings without affecting the effect of the sheath on fixing the wire rings. Furthermore, the velvet woven grid surface enables the bra to maintain fluffiness in the position of the sheath and smooth on both ends of the hollow part, thus greatly improving comfort in wearing.

The above-mentioned are only the preferable embodiments of the present invention. It should be not limit the implementation range of the invention, and all the technical schemes realizing the objectives of the invention by basically the same means are all within the protective range of the invention.

The invention claimed is:

1. A velvet sheath for bra wire rings, comprising a main body holding a hollow part and formed by an upper fabric and a lower fabric, wherein the main body is provided with velvet warp threads for connecting with the upper fabric and the lower fabric along the hollow part, the upper fabric and the lower fabric are interwoven and connected by the velvet warp threads crossed up and down, respectively, and the velvet warp threads are filled on both sides of the hollow part formed by the upper fabric and the lower fabric.

2. The velvet sheath for bra wire rings according to claim 1, wherein the velvet warp threads form velvet woven grid surfaces on both sides of the hollow part of the sheath for bra wire rings.

3. The velvet sheath for bra wire rings according to claim 2, wherein a height of the velvet woven grid surfaces is equal to a height of the hollow part.

4. The velvet sheath for bra wire rings according to claim 3, wherein a ratio of a width between the velvet woven grid surfaces on both sides of the hollow part to a width of the hollow part is between ½ and ⅘.

5. The velvet sheath for bra wire rings according to claim 4, wherein the width of the hollow part is between 8 and 13 mm, and the width between the velvet woven grid surfaces on both sides of the hollow part is between 6 and 10 mm.

6. The velvet sheath for bra wire rings according to claim 5, wherein the width of the hollow part is between 10 and 12 mm, and the width between the velvet woven grid surfaces on both sides of the hollow part is between 7 and 9 mm.

7. The velvet sheath for bra wire rings according to claim 1, wherein the main body is integrally formed by weaving.

8. A bra using the velvet sheath for bra wire rings according to claim 1, the velvet sheath for bra wire rings is sewn under bra cup.

* * * * *